United States Patent [19]

Nick

[11] 4,296,928

[45] Oct. 27, 1981

[54] INTERPLANETARY CONFLICT GAME

[76] Inventor: Howard H. Nick, Darren Rd., La Grangeville, N.Y. 12540

[21] Appl. No.: 100,463

[22] Filed: Dec. 5, 1979

[51] Int. Cl.[3] ..... A63F 3/00; A63F 3/04

[52] U.S. Cl. ..... 273/262; 273/290

[58] Field of Search ..... 273/250, 251-253, 273/256, 262, 255

[56] References Cited

U.S. PATENT DOCUMENTS

| | | | |
|---|---|---|---|
| 972,382 | 10/1910 | Johnson | 273/262 |
| 4,010,954 | 3/1977 | Uding | 273/256 |
| 4,157,184 | 6/1979 | Recard, Jr. | 273/256 |

OTHER PUBLICATIONS

*Wooden Ships and Iron Men; Introduction to Rules,* ©1975, Avalon Hill Game Co.

*Jutland; Game Rules,* ©1967, 1974, Avalon Hill Game Co.

*Primary Examiner*—Richard C. Pinkham

*Assistant Examiner*—R. Carl Moy

*Attorney, Agent, or Firm*—Stephen E. Feldman; Marvin Feldman

[57] ABSTRACT

An interplanetary conflict game comprises a game board having first indicia thereon which are symbolic of the solar system and include planets, stars, and travel routes between the stars. The gameboard also includes a second indicia to determine the distance between the stars. A plurality of rocket markers for each player are manually moved by a player between the stars and planets and are used to fire at an opponent player's rocket or to capture an opponent's planet. A group of rating spheres used in conjunction with each rocket marker indicate the numerical rating of the rocket markers. A firing chart determines a firing range between a players rocket and an opponent's rocket. A promotion chart is used for determining the proper rating sphere for the rocket markers. A legend chart indicates the number of moves for a rocket marker as indicated by its rating sphere. A group of firing cards are drawn by a player desiring to have his rocket fire upon a rocket belonging to an opponent player and instructs the player as to whether the rocket has hit or has missed.

7 Claims, 11 Drawing Figures

41
5
46
48
45
47

38
24
37

41
43
5
42
39
26
23
20
74
22
18
20
12
72
70
18
23
NEPTUNE
JUPITER

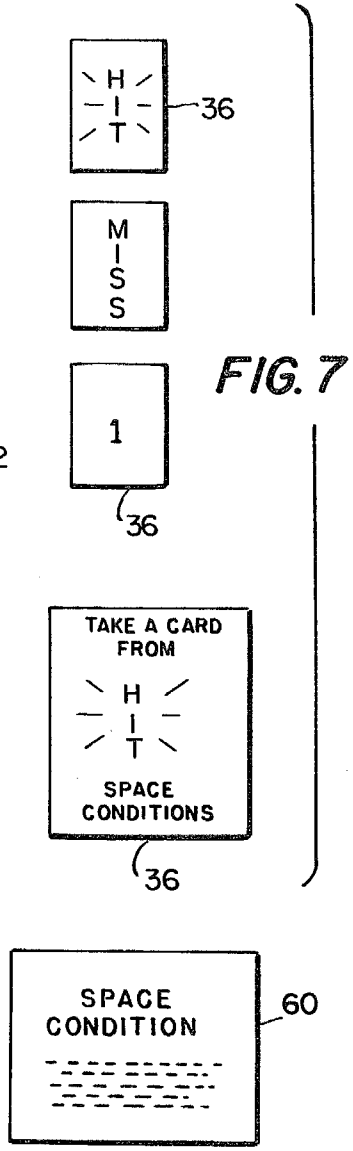
FIG. 7
FIG. 8
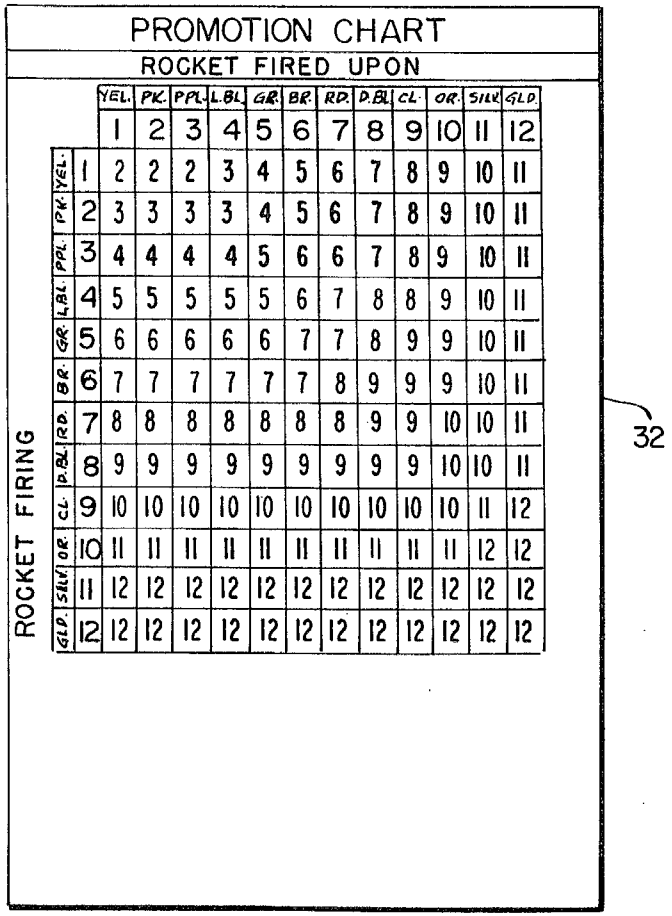
FIG. 5
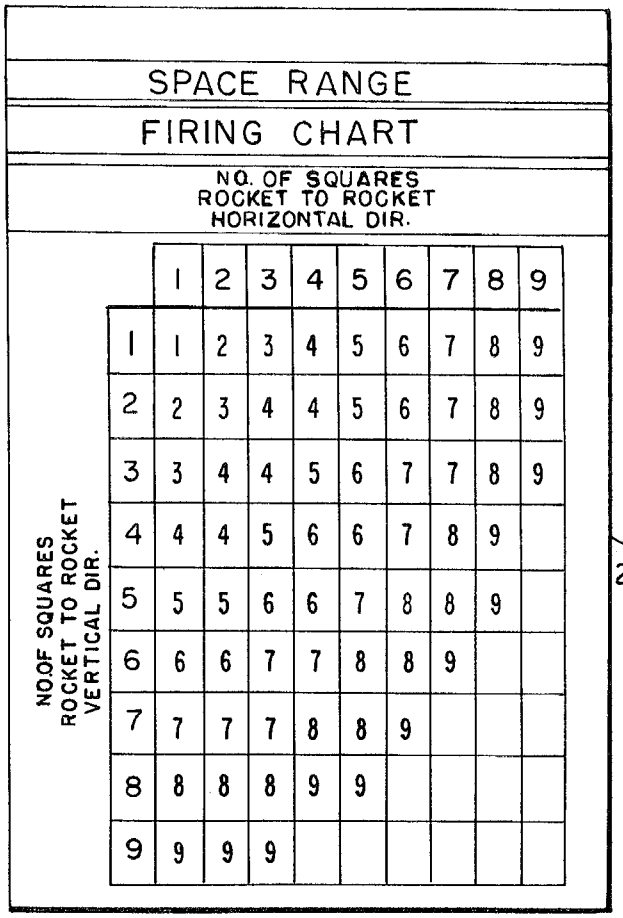
FIG. 4

LEGEND

| NUMBER & SPHERE COLOR (50) | MOVES (52) | RANK (54) |
|---|---|---|
| 1 YELLOW | 1 STAR | SPACE SHIP 3RD. CLASS |
| 2 PINK | 2 STARS | SPACE SHIP 2ND. CLASS |
| 3 PURPLE | 3 STARS | SPACE SHIP 1ST. CLASS |
| 4 LT. BLUE | 4 STARS | SPACE CRUISER 3RD. CLASS |
| 5 GREEN | 5 STARS | SPACE CRUISER 2ND. CLASS |
| 6 BROWN | 6 STARS | SPACE CRUISER 1ST. CLASS |
| 7 RED | 7 STARS | FLEET LT. COMMANDER |
| 8 DK. BLUE | 8 STARS | FLEET COMMANDER |
| 9 CLEAR | 9 STARS | PLANET LT. COMMANDER |
| 10 ORANGE | 10 STARS | PLANET COMMANDER |
| 11 SILVER | 11 STARS | STAR SYSTEM COMMANDER |
| 12 GOLD | 12 STARS | GALAXY COMMANDER |

34

FIG. 6

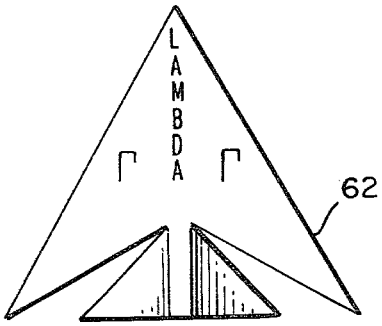

FIG. 9

INTERPLANETARY CONFLICT GAME

BACKGROUND OF THE INVENTION

While the invention is subject to a wide range of applications, it is especially suited to be used as a game device and will be particularly described in that connection.

Game devices employing game boards with paths of movement delineated thereon for movement of game pieces under control of a chance device are well known. Further game devices relating to space travel are also generally known as exemplified in prior art U.S. Pat. Nos. 3,037,773; 3,223,420 and 3,985,361.

It is an object of the present invention to provide a new game called "Cosmos" which includes a gameboard having multifarious paths of movement delineated thereon for movement of game pieces in accordance with instructions provided by the rules whereby the game pieces are moved with the objective of capturing the rockets and planets of an opposing player or players.

It is a further object of the present invention to provide a game having a game board which includes two types of indicia for both symbolizing the solar system as well as determining the distance between rockets.

A further object of the present invention is to provide a game which will be entertaining, intriguing and educational as well as to develop a player's innate abilities of planning, adapting to changing conditions, working well with others, and achieving specific goals.

A further object of the present invention is to provide a game which is relatively simple in construction, inexpensive to manufacture, and able to provide amusement for various age groups.

SUMMARY OF THE INVENTION

Accordingly, there has been provided an interplanetary conflict game comprising a game board having first indicia thereon which are symbolic of the solar system and include planets, stars, and travel routes between the stars. The gameboard also includes a second indicia to determine the distance between the stars. A plurality of rocket markers for each player are manually moved by a player between the stars and planets and are used to fire at an opponent player's rocket or to be moved onto a planet. A group of rating spheres used in conjunction with each rocket marker indicate the numerical rating of the rocket markers. A firing chart determines a firing range between a player's rocket and an opponent's rocket. A promotion chart is used for determining the proper rating sphere for the rocket markers. A legend chart indicates the number of moves for a rocket marker as indicated by its rating sphere. A group of firing cards so constructed as to provide a probability of success or failure, are drawn by a player desiring to fire his rocket at an opposing player's rocket and to instruct the player as to whether the rocket has hit or has missed.

For a better understanding of the present invention together with other and further objects thereof, reference is had to the following description, taken in connection with the accompanying drawings, while its scope will be pointed out in the appended claims.

BRIEF DESCRIPTION OF THE DRAWINGS

FIG. 4 is a plan view of a space range firing chart;

FIG. 5 is an illustration of a promotion chart in accordance with the present invention;

FIG. 6 is an illustration of a legend chart of the present invention;

FIG. 7 is an illustration of several differet firing cards of the present invention;

FIG. 8 is an illustration of a space condition card of the present invention; and FIG. 9 is a plan view of a planet leader flag of the present invention.

DESCRIPTION OF THE PREFERRED EMBODIMENT OF THE INVENTION

Figure 1:
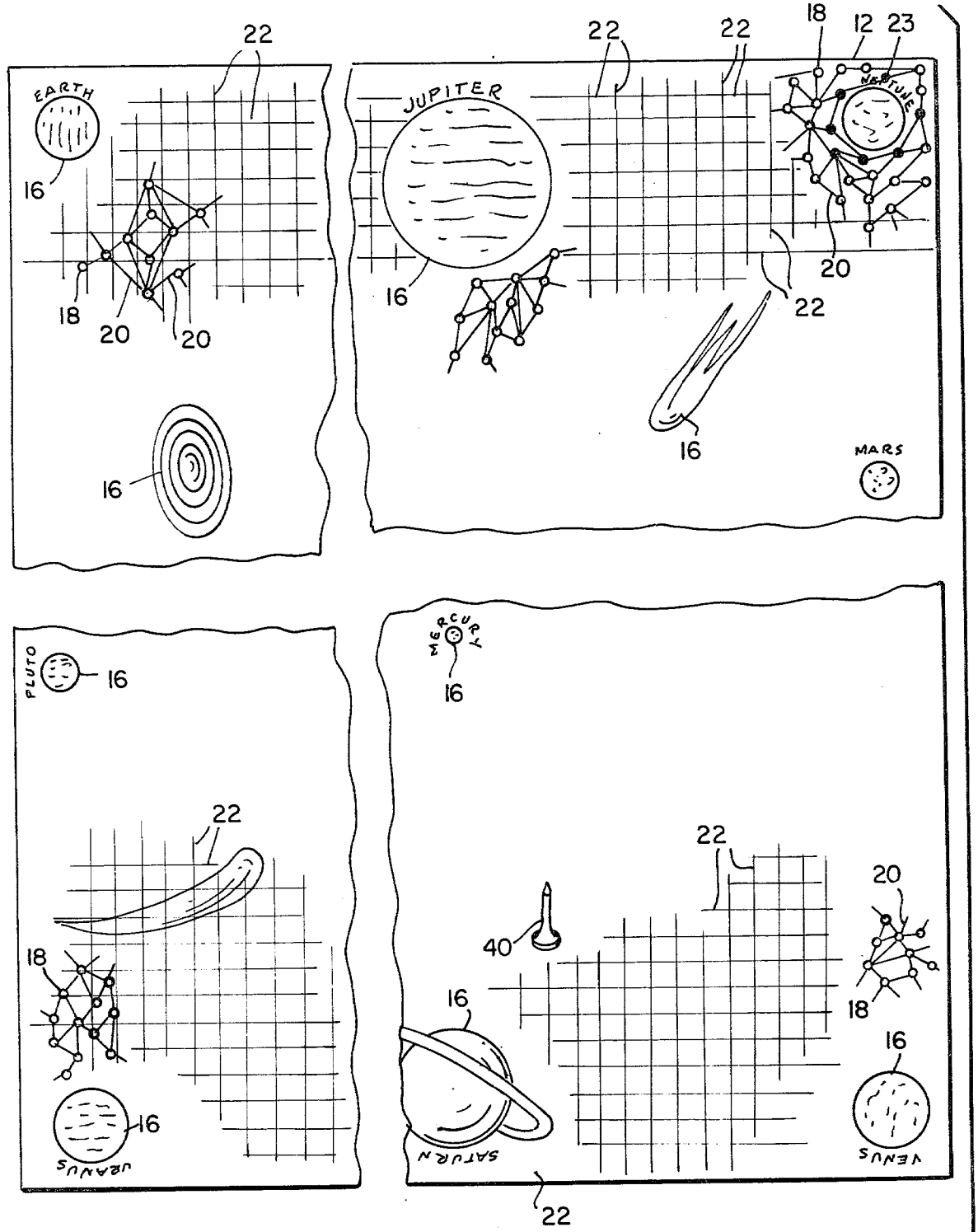
FIG. 1 is a plan view of sections of the game playing board in accordance with the present invention.

An interplanetary conflict game comprises a gameboard 12 which has first indicia thereon symbolic of the solar system. The first indicia includes planets 16, stars 18, and travel routes 20 between the stars. The gameboard 12 also includes second indicia 22 to determine the distance between the stars 18. A plurality of rocket markers 24 for each player may be manually moved by a player between the stars and the planets and are used to fire at an opponent player's rocket or land upon his planet. A group of rating spheres 26 used in conjunction with each rocket marker indicate the numerical rating of the rocket markers. A firing chart 28 determines a firing range between a player's rockets and an opponent's rocket. A promotion chart 32 is for determining the proper rating sphere for the rocket markers. A legend chart 34 is provided for indicating the number of moves for a rocket marker as indicated by its rating sphere. A group of firing cards 36 are provided to be drawn by a player wishing to fire his rocket at a rocket belonging to an opponent player and instructs the player as to whether the rocket has hit or missed.

Referring to FIG. 1, there is illustrated a game board 12 having printed thereon a miniature representation of our solar system. The first indicia may include nine large prominent planets 16. A number of dots 18 represent stars which are connected by lines or travel routes 20. The board 12 is divided in half. On one side are the four planets: Venus, Saturn, Uranus, and Pluto; and on the other side are the four planets: Mars, Neptune, Jupiter and Earth. In the middle of the board is Mercury. This latter planet, Mercury is not needed in the play of the game but is only used to illustrate realism as are the comets and nebulae. The board also contains second indicia comprised of a grid work of squares 22 which underly the first indicia. Most of the squares contain one star and a few contain two stars. Each planet is surrounded by six dark stars 23 which may be of a desired color such as red.

The dimensions of the four larger planets, as seen in FIG. 1, are in direct proportion to one another and the five smaller planets are also in direct proportion to one another. All of the planets on the board are in relative proportion to one another and they are scaled to our solar system. In addition, their markings and colors, where possible, are representative of the planets based on present day information.

Figures 2, 2A, 3, 3A:
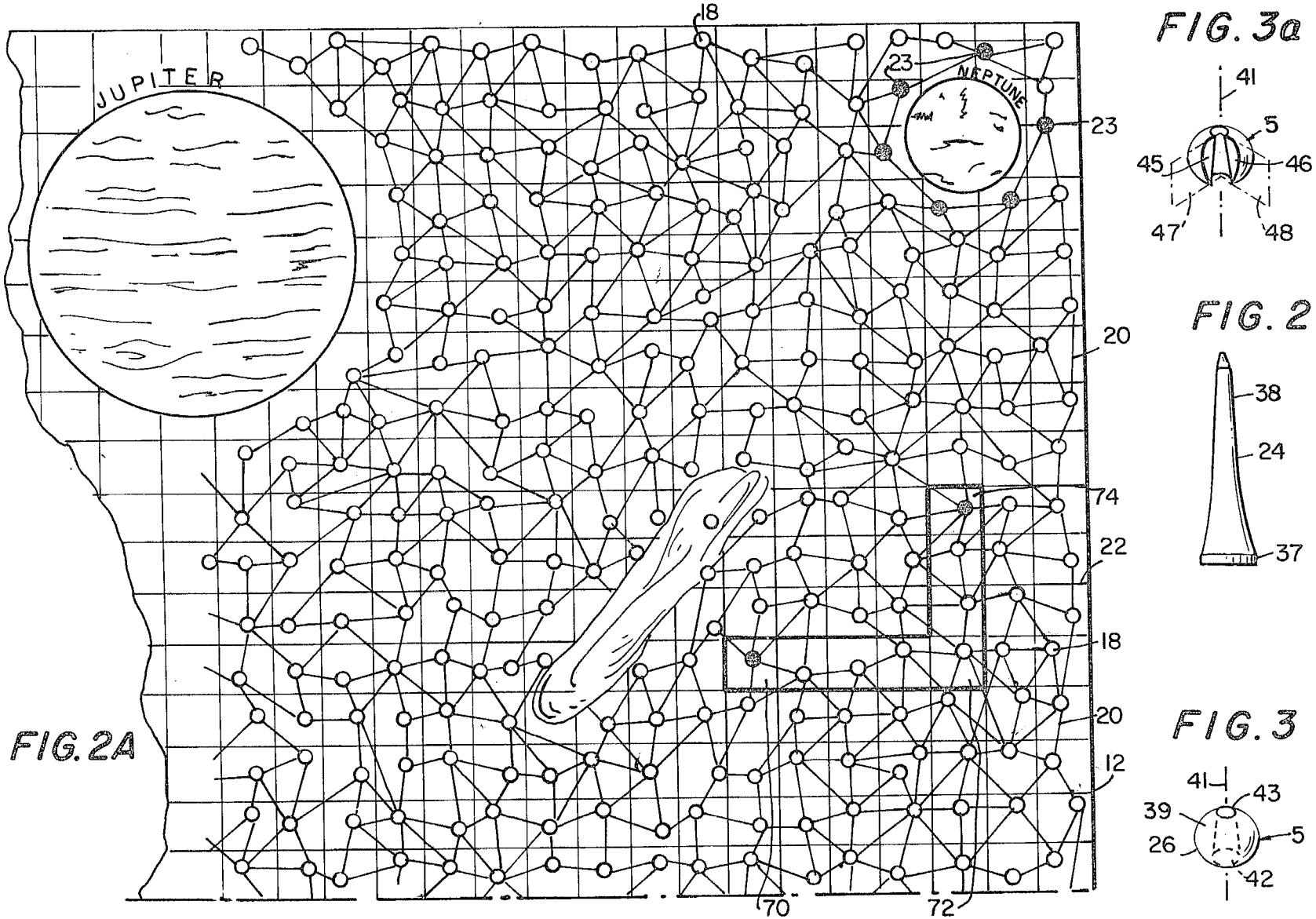
FIG. 2 is a side view of the rocket marker used in the game to mark the player's position on the gameboard.
FIG. 2A is a plan view of a portion of the gameboard.
FIG. 3 is a perspective view of the rating sphere of the present invention.
FIG. 3A is a perspective view of a second embodiment of a rating sphere.

As illustrated in FIG. 2, a plurality of rocket markers 24 are provided. In general, there are fourty rockets having eight different colors. The rockets are divided so that there are five rockets of each color. The rocket markers are shaped so as to have a base 37 so that the marker can stand independently on the gameboard 12. Also, the marker includes concial shaped body 38 adjoined to the base section for receiving the rating spheres as will be further explained.

The rating spheres 26, as shown in FIG. 3, provide twelve different groups of ratings in the form of small doughnut-shaped colored bodies. Each color group corresponds to a different numerical rating which is set forth on the legend chart 34. Although specific colors are suggested, it is within the scope of the present invention to use any colors desired. The numerical rating may be further indicated by a number printed on the surface of the body. The rating spheres are formed with an external curved surface 39 preferably doughnut-shaped. It is however, within the scope of the present invention to make them any shape such as spherial or cubical. They each have a conical-shaped passageway 40 extending along a center line 41 passing through the bodies. A circular opening 42 is located at one end of the passageway and a second smaller opening 43 is located at the other end of the passageway. The shape of the passageway 40 is approximately the same shape as a portion of the conical-shaped body 38. When the body 38 is inserted into the passageway 40, the body firmly attaches to the rocket marker along the length of the conical-shaped body. The rating spheres may be formed of any desired material such as, plastic, wood or metal.

When a rating sphere is pressed onto the conical-shaped body, it may be difficult to disengage the bodies from each other. Therefore, in a second embodiment of the invention, as shown in FIG. 3A, a slot 44 is provided in the body of the rating sphere to allow less surface area of the passageway 40 to contact the body 38 of the marker. The rating sphere can be more easily removed, and if necessary, pried loose from the body 38. The slot is defined by two walls 45 and 46 formed along two planes 47 and 48 each extending from the centerline 41 beyond the external curved surface 39 at an angle of between 15° to 90° to each other.

A space range firing chart 28, illustrated in FIG. 4, contains a matrix of numbers. The chart is consulted when a player wishes to fire a rocket at an enemy rocket and is used to determine the firing range between the two rockets. Details concerning the use of this chart will be further explained below.

A promotion chart 32 is illustrated in FIG. 5 and consists of a matrix of numbers. This chart is consulted when a rocket has fired at and hit an enemy rocket and is used to determine the promotion given to the firing rocket as a reward for its excellent performance in battle. The use of this chart will be explained below.

A legend chart 34, as illustrated in FIG. 6, has three columns. The first column 50 lists all of the different rating spheres by number and corresponding color. The middle column 52 lists the number of stars a rocket may move during one turn, as determined by the color of its rating sphere. The third column 54 of the chart lists the rank or title relating to each different colored rating sphere.

Referring to FIG. 7 there is illustrated several examples of the firing cards 36 which are provided with the game. Preferably, there are ninety firing cards divided into nine groups. The groups are numbered from one to nine. These cards are picked by a player when he wishes to fire a rocket at an opponent's rocket. Each group contains 10 cards which are either marked hit or miss. The number on the backside of each card in the group represent the number of misses in that group and the remaining cards in the group are hits. This enables the player to determine his chances of getting a hit when firing. Two cards in each group say "take a card from space conditions". These latter cards are explained below.

Referring to FIG. 8, there is shown an example of a space condition card 60. Fifteen of these cards may be provided with the game. Each card describes a unique set of conditions and instructions to the player to be followed during the play of the game. For instance, a card might state "Firing systems temporarily out of order. During your next turn your rocket may move, but cannot fire".

There are eight colored groups of planet leader flags, of the type illustrated in FIG. 9, which correspond to matching color groups of rocket markers. Each group of one color consists of eight flags bearing the following insignias: Alpha; Beta; Gamma; Delta; Kappa; Lambda; Sigma; and Omega. The use of these flags will be described below.

The object of the game is to capture an opponent's planet. This can be accomplished in two ways. Either by firing upon, hitting and therefore eliminating an enemy planet's rockets, or by landing a rocket on an opponent's planet. The game is won when one individual or team succeeds in capturing all of the opponents' planets.

Any number of players from two to eight may play but for the sake of simplicity, the game will be described herein with four players. Since the board 12 is divided into two parts, the four players will chose partners who will then become allies and two players will take possession of two of the four planets on one side of the board and the other two players take two of the four planets on the other side of the board. During the game, players may discuss with their allies their plan of attack or defense against their opponents. In playing a game, the following rules are preferably observed.

Each player choses one of the four planets on his side of the board. Then each player takes five rockets of the same color and places them on his planet or off the board near his planet. Then the players each take five rating spheres in this order: Yellow; Pink; purple; light blue; and red and places them on the top of his rockets for each planet. The players select a planet leader flag 62 with the name of his choice inscribed thereon (i.e., planet leader alpha, beta, etc). This name is the player's title throughout the rest of the game. The color of the planet leader flag selected should match the color of the player's rockets. The flag is placed on the player's planet. The players choose who moves first and thereafter the turns are made in a clockwise manner according to planet. The firing cards 36 are separated into their nine groups and laid out where they can be easily reached such as next to the board. The space condition cards are similarly placed near the board.

To start the game, all of the players, during their first turn, must move all of their rockets off their respective planets onto the board. The rockets move from one star to another in any direction according to the color of the rating sphere as set forth on the legend 34. For example, when a player is ready to begin his turn, he picks up one of the rockets which bears the rating sphere color purple. The purple color on the rating sphere allows it to move three stars in any direction as set forth in the legend. He then proceeds by starting on one of the red stars 23 mentioned above surrounding his planet. This star is counted as one, the next star connected by a line 20 is two and the third star connected by a line is three. This completes that rocket's first move and it remains on that star until the player's next turn. The player continues to move the rest of his rockets in the same manner, starting from any one of the red stars surrounding his planet. After all the rockets are moved from the player's planet, the player's first turn is completed and the other players in turn move their rockets in the same manner. All the players have now completed their initial move.

During all turns after the initial move, a player has the following options with regard to each of his rockets. Each rocket may be permitted to do one of the following: (1), move, (2) fire, (3) remain inactive in its present position. It should be noted that a given rocket cannot both move and fire during a player's turn. The movement of a rocket from star to star proceeds in the following manner. Assume a player wishes to move one of his rockets having a rating sphere colored light blue. This allows it to move up to four stars during its turn. It moves four consecutive stars in a preferred direction from the star it is presently on and finally stops on the fourth star until its next turn. If the player wished to move the rocket less than four stars, for example two stars, he may do so. In other words, he may move a rocket any number of stars as long as it does not exceed its rating. A rocket cannot move from one star to another unless there is a line connecting the stars.

As the game progresses, the rockets of both sides will soon come into close contact with one another. The following procedure is used in firing upon an enemy rocket. The second indicia 22 composed of the grid work of squares is used in the firing procedure to determine the distance between the rocket firing and the enemy rocket being fired upon. The number of squares in the horizontal and vertical directions between the rocket being fired and the rocket being fired upon must first be determined.

Referring to FIG. 2A, the player counts the number of squares in a horizontal direction beginning with the square 70 containing the rocket firing and stopping on the square 72. The square 72 is in a direct vertical line with the square 74 containing the enemy rocket being fired upon. In this example, the horizontal count is 5. This is the number of squares rocket-to-rocket in the horizontal direction.

Counting from and including the square labeled 72 in FIG. 2A, the player counts the number of squares in the vertical direction to the enemy rocket being fired upon. In this example the vertical count is 4. This is the number of square rocket-to-rocket in the vertical direction.

The player now consults the space range firing chart. The number of squares rocket-to-rocket in the horizontal direction (5 in our example) can be found in the row of large numbers (1–9) shown across the top of the space range firing chart. The number of squares rocket-to-rocket in the vertical direction (4 in our example) can be found in the column of large numbers shown along the left-hand side of the space range firing chart. To find the distance between the rocket firing and the enemy rocket being fired upon, the player determines the crosspoint (6 in our example) between the latter two numbers. This is the firing range between the two rockets discussed in our example. Note that the blank squares on the space range firing chart indicates that the rocket firing is out of range and cannot fire. Of course the rocket can still be moved or fire upon another enemy rocket within firing range or remain in the present position.

If the player elects to fire, he goes to the group of firing cards 36 which correspond to the firing range determined above and picks the top card. In our example, the firing range was 6. Therefore he picks the top card from the group of firing cards numbered 6.

If the card says "Miss", then the rockets turn is finished and it must remain on the star until the next turn. The card is then replaced on the bottom of the pile it was taken from. If the card says "Hit", the rocket fired upon is temporarily eliminated and is removed from the board. The card saying "Hit" is then reshuffeled into its appropriate pile and not placed at the bottom. The rocket firing receives a promotion as explained below upon completing its turn and remains on its star until the next turn.

As mentioned above, two of the cards in each group of firing cards 36 have the words "take a card from space conditions" printed on them. When a player picks one of these cards, he also picks up a space condition card 60 and follows the directions thereon. This card is then placed at the bottom of the space conditions pile.

It is important to note that a player cannot fire his rocket if a straight edge cannot be placed between the two stars containing the rocket firing and the rocket being fired upon without crossing a planet or crossing a star that another rocket is occupying. Rockets can fire through the comets and spiral nebulae as well as through the rings of Saturn but not through planets including Mercury.

If a rocket has fired and hit an enemy rocket, the promotion chart 32 is consulted to see if a higher rating should be given to the rocket that has fired. For example, if a rocket with a rating sphere colored pink (2) has fired and hit a rocket bearing the rating sphere colored red (7), the promotion chart must be consulted. On the extreme left of the chart, the words "Rocket firing" and a column of ratings beginning with yellow (1) and concluding with gold (12) are provided. Across the top of the chart, the words "rocket being fired upon" are written and under this is a row of ratings beginning with yellow (1) and concluding with gold (12). In order to determine what rating the pink (2) would get for hitting a red (7), the player places his finger on the two rating where "rocket firing" is written. The then brings his finger across the chart until it is in the square under red (7) where "rocket being fired upon" is written. In this square is a small number 6. This number indicates that his rocket bearing a pink colored sphere is to be promoted to the rank of 6 or brown. The pink sphere is removed and a new rating sphere colored brown is placed on top of the rocket. This rocket is now entitled to move six stars during its turn. This promotion procedure should be performed each time a rocket is hit.

Now that it is known how to both move and fire with rockets, it can be shown how to capture an enemy's planet in the two ways mentioned earlier. The first is by firing upon and hitting an opponent's five rockets. The player whose rocket has hit the last of the enemy's five rockets is the rightful possessor of the captured planet. At this point the following steps are taken: (1) the rocket which fired and hit the last enemy rocket is promoted by consulting the promotion chart 32 as mentioned above. In addition, this rocket is given a bonus promotion of one rank higher for capturing the opponent's planet. (2) This rocket is now returned to its home Planet. (3) the remaining four rockets of the same color group are also returned to that same planet, regardless of whether these rockets are still in play on the board or if they have been previously hit. These four rockets retain their present ranks, i.e. rating spheres. (4) all five of the captured planet's rockets are now returned to the captured planet. These five rockets retain their present ranks. The conquering player now removes the planet leader flag from the captured planet and replaces it with a planet leader flag bearing his title in the same color as the planet leader flag just removed from the captured planet. (6) the conquering planet's turn is now completed.

The opponent is now out of the game (assuming he has no other planets) and the player continues during the game to pursue his opponent's allies with his own as well as with the newly acquired planet with its five rockets.

It should be remembered, that the turns are taken in succession by planet in a clockwise manner at all times, even though planets may change hands during the game. On the next respective turns of both these respective planets, all rockets must be moved onto the board as in the beginning move of the game.

A player may also capture a planet if he is able during his moves to maneuver one of his rockets to land onto the enemy's planet. Note that prior to landing on the enemy planet, a player's rocket must stop on a red star surrounding the enemy planet and remain there until its next turn before it can be moved onto the planet.

When the rocket succeeds in moving onto that planet, the planet is captured and the same procedure is followed as in the above mentioned procedure wherein the five rockets are hit. Remember that the rocket landing on the enemy's planet receives a bonus promotion of one rank higher for capturing the opponent's planet.

In regards to either of the methods of capturing a planet, both the captured planet and the conquering planet are immune from recapture for the next two of their respective turns. To recapture a planet, the same method is carried out as in capturing a planet. A player remains in the game as long as he has a planet. The game is won when one team has succeeded in capturing all of their opponents' planets.

It will be understood by one skilled in the art that there has been described a game which has a multifarious path of movement delineated for movement of pieces in accordance with instructions from the rules, has two types of indicia, is entertaining, intriguing, educational, simple in construction and inexpensive to manufacture.

While there has been described what is at present considered to be the preferred embodiment of the invention it will be obvious to those skilled in the art that various changes and modifications may be made therein, without departing from the invention such as for example, changes in colors and values of colors and indicia. It is, therefore, aimed in the appended claims to cover all such changes and modifications as fall within the true spirit and scope of the invention.

I claim:

1. An interplanetary conflict game comprising:

(a) a gameboard having first indicia thereon symbolic of the solar system including planets, stars, and travel routes between the stars, said gameboard further including second indicia to determine the distance between said stars, (b) a plurality of rocket markers for each player to be manually moved by a player between said stars and planets and to fire at an opponent player's rocket or to capture an opponent's planet, (c) a group of colored rating spheres, each having an external curved surface, a conical-shaped passageway extending along a center line through a rating sphere, and a slot extending the length of the center line for easy removal of the rating sphere from a rocket marker to which it is attached in order to indicate the numerical rating of the rocket markers, (d) a firing chart for determining a firing range between a player's rocket and an opponent's rocket, (e) a promotion chart for determining the proper rating sphere for said rocket markers, (f) a legend chart for indicating the number of moves for a rocket marker as indicated by its rating sphere, (g) a group of firing cards to be drawn by a player desiring to fire his rocket at a rocket belonging to an opponent player instructing the player as to whether the rocket hits or misses.

2. The interplanetary conflict game as defined in claim 1 wherein said slot is defined by two walls formed along two planes each extending from the center line to the external curved surface at an angle of between 15° to 90° to each other.

3. The interplanetary conflict game as defined in claim 2 wherein said rocket markers have a base section and a conical-shaped body adjoined to the base section wherein said conical-shaped body is received within the conical-shaped passageway in said rating sphere to attach the rating sphere to the rocket marker.

4. The interplanetary conflict game as defined in claim 3 wherein said promotion chart comprises a matrix of numbers having a topmost set of horizontal numbers corresponding to the color of the rating sphere on a rocket fired upon and a left most set of vertical numbers corresponding to the color of the rating sphere on a rocket firing, whereby entering the matrix enables the players to determine the increase of the rating sphere whenever the player's rocket fires upon and hits an opponent's rocket.

5. The interplanentary conflict game as defined in claim 4 wherein said indicia includes a gridwork of squares having one of said first indicia in each said square, and preselected squares near the edge of said game board having two of said first indicia in each said square.

6. The interplanetary conflict game as defined in claim 5 wherein said firing chart comprises a matrix of numbers having a topmost set of horizontal numbers corresponding to the horizontal distance between rockets and a left most set of vertical numbers corresponding to the vertical distance between rockets whereby entering the matrix enables the player to determine which group of firing cards is to be chosen.

7. The interplanetary conflict game as defined in claim 6 wherein said firing cards are divided into 9 groups with each group being numbered to correspond to the number chosen from the firing chart, each of said groups of firing cards consisting of ten cards such that the number of the group indicates the number of miss cards in that group to provide a realistic probabilistic chance of scoring a hit upon an enemy rocket depending upon and related to the latter's proximity to the rocket firing.

* * * * *